US005305477A

United States Patent [19]

Cochran

[11] Patent Number: 5,305,477

[45] Date of Patent: Apr. 26, 1994

[54] SHOWER CURTAIN BRACE

[76] Inventor: Scott Cochran, Goerdelerweg #6, 6100 Darmstadt, Fed. Rep. of Germany

[21] Appl. No.: 988,226

[22] Filed: Dec. 9, 1992

[51] Int. Cl.[5] ..... A47K 3/00

[52] U.S. Cl. ..... 4/609; 4/605; 4/607

[58] Field of Search ..... 4/558, 607, 608, 609, 4/610; 160/349.1, 349.2; 49/67, 420, 163; 292/338, DIG. 46; 16/124

[56] References Cited

U.S. PATENT DOCUMENTS

| | | | |
|---|---|---|---|
| 3,717,884 | 2/1973 | Mantooth | 16/124 |
| 3,724,000 | 4/1973 | Eakman | 4/609 |
| 4,229,842 | 10/1980 | Gilmore | 4/610 |
| 4,361,914 | 12/1982 | Oliver | 4/610 |
| 4,798,407 | 1/1989 | Miller | 292/DIG. 46 |
| 5,103,531 | 4/1992 | Perrotta | 4/608 |

FOREIGN PATENT DOCUMENTS

| | | | |
|---|---|---|---|
| 49005 | 5/1990 | European Pat. Off. | 4/610 |

*Primary Examiner*—Henry J. Recla
*Assistant Examiner*—Charles R. Eloshway
*Attorney, Agent, or Firm*—Kolisch, Hartwell, Dickinson, McCormack & Heuser

[57] ABSTRACT

A shower curtain brace is provided for securing a lower portion of the shower curtain away from the shower stream when the shower curtain is extended across the shower entrance. The brace includes a bar with two ends perpendicularly oriented to a longer middle section. One end of the bar is pivotally mounted on a first wall of the shower so that the bar may move between a non-use-position in which the bar is substantially parallel and adjacent to the first shower wall, and a use-position in which the bar lies across the shower entrance approximately perpendicular to the shower walls. The distal end of the bar has a friction-reducing roller to facilitate contact and movement of the distal end against the curtain along the surface of the opposing shower wall. A clip is provided for mounting on the first shower wall above the hinge for capturing and holding the distal end of the bar when the brace is in its non-use-position. In actual use, the bar impinges against the lower portion of the shower curtain effectively pinning it against the top of the entrance ledge and preventing the shower curtain from moving into the shower stream or space. In a preferred embodiment, the distal end of the bar is approximately L-shaped so that the curtain can be fully extended and tautly held against the opposing shower wall, thus, sealing off the entrance and preventing water from exiting the shower compartment.

13 Claims, 3 Drawing Sheets

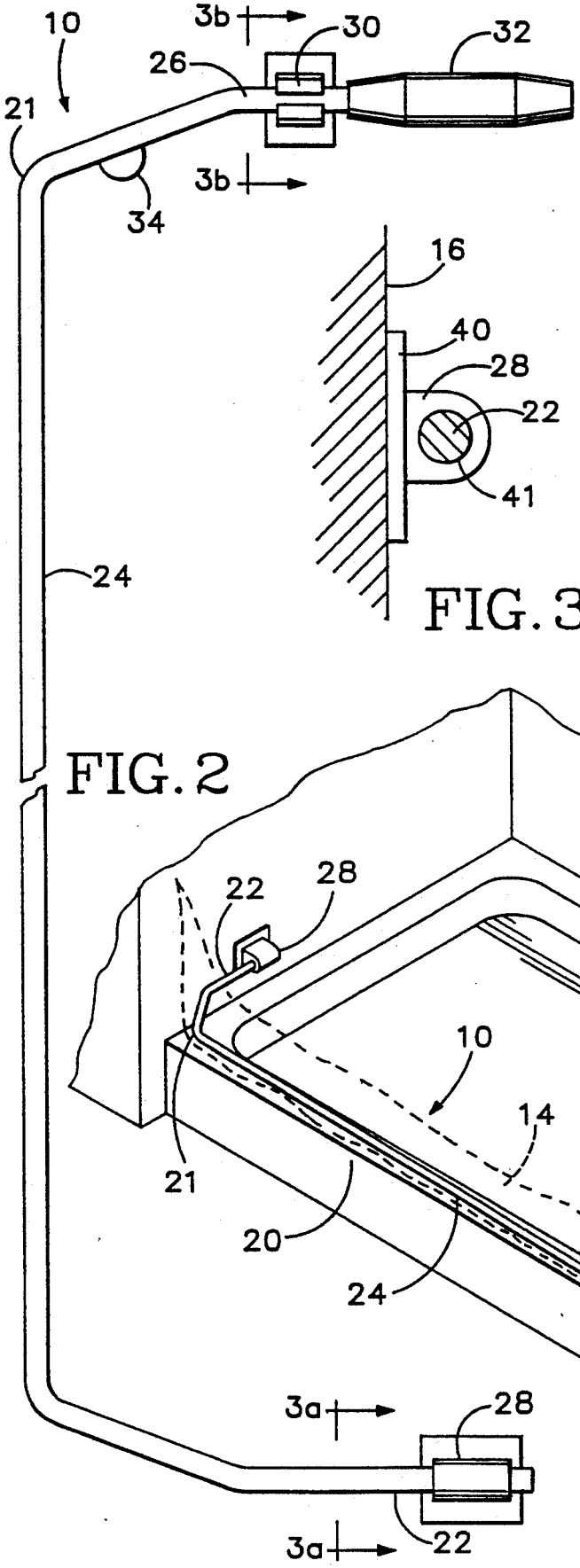
FIG. 2
FIG. 3a
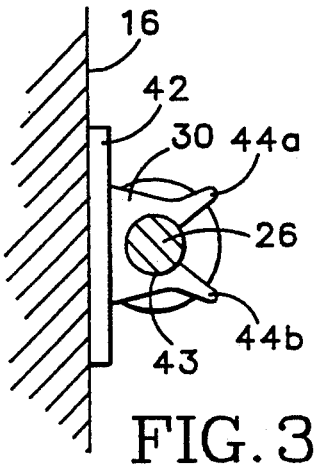
FIG. 3b
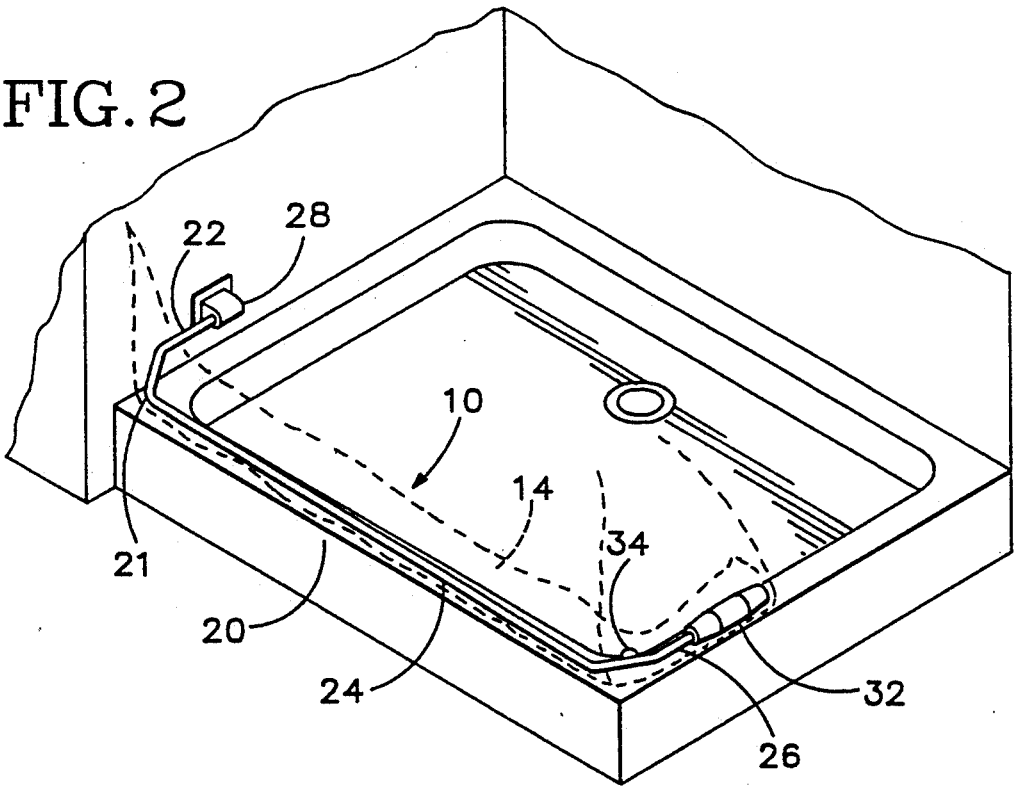
FIG. 4

SHOWER CURTAIN BRACE

FIELD OF THE INVENTION

The invention relates to shower curtain supporting devices, and in particular involves a brace which prevents a shower curtain from moving into the shower space and prevents shower water from escaping the shower compartment.

BACKGROUND OF THE INVENTION

Shower curtains have been used for many years in many different types of showers to prevent water from escaping the shower space or area. Practically everyone who has ever taken a shower next to a shower curtain has experienced the frustrating problem of having the curtain move toward the primary shower space as if the curtain is drawn to the shower stream. The inward curtain movement interferes with the showering activity by decreasing useable shower space and by actually contacting and sticking to the person who is showering. Another problem caused by an inwardly drifting shower curtain is that water is allowed to escape through gaps between the curtain and the surrounding shower walls.

People often try to prevent the curtain from drifting inward by making the bottom portion of the curtain adhere to the wall of the shower stall. However, this approach is an unsatisfactory temporary solution to the problem because the curtain usually pulls away from the shower wall moving back toward the shower stream.

SUMMARY OF THE INVENTION

The present invention provides a simple and effective solution to the problems discussed above. In the present invention, a bar has first and second end portions separated by a middle portion. The first end portion of the bar is attached to a hinge which is capable of being mounted on a first shower wall opposite from a second shower wall adjacent to the shower entrance. The length of the bar is equal to or slightly greater than the distance between the first and second walls. When the bar is mounted, it is movable between a non-use-position in which the bar is substantially parallel and adjacent to the first shower wall, and a use-position in which the bar is substantially parallel to the shower floor. When the bar is in its use-position, the bar impinges against the shower curtain just above the entrance ledge of the shower, thus, preventing the curtain from moving into the shower stream or space and preventing shower water from exiting the shower compartment.

In a preferred embodiment, the second end portion of the bar has a friction-reducing roller which allows the second end portion to easily move along the surface of the second shower wall, preferably pinning a side section of the curtain against the wall, as the bar is moved into its use-position. A clip is suitably located and mounted on the first shower wall above the hinge so that it may capture and hold the second end section when the bar is in the non-use-position.

BRIEF DESCRIPTION OF THE DRAWINGS

FIG. 2 is a partial side view of a brace in a preferred embodiment of the present invention, showing the end portions of the bar fastened to a wall by a hinge and a clip.

FIG. 3*a* is a sectional view of the hinge shown in FIG. 2.

FIG. 3*b* is a sectional view of the clip shown in FIG. 2.

FIG. 4 is a partial perspective view of a lower portion of a shower in which a brace, according to a preferred embodiment of the present invention, is in its use-position.

DETAILED DESCRIPTION OF THE PREFERRED EMBODIMENTS

The shower brace of the present invention may be used in practically any type of shower. The preferred embodiments are shown and described below in the context of a shower stall. However, those skilled in the art will readily understand that the present invention may be applied to other types of showers such as tubs or any other type of shower which employs a curtain to prevent water from escaping the shower space.

Figure 1:
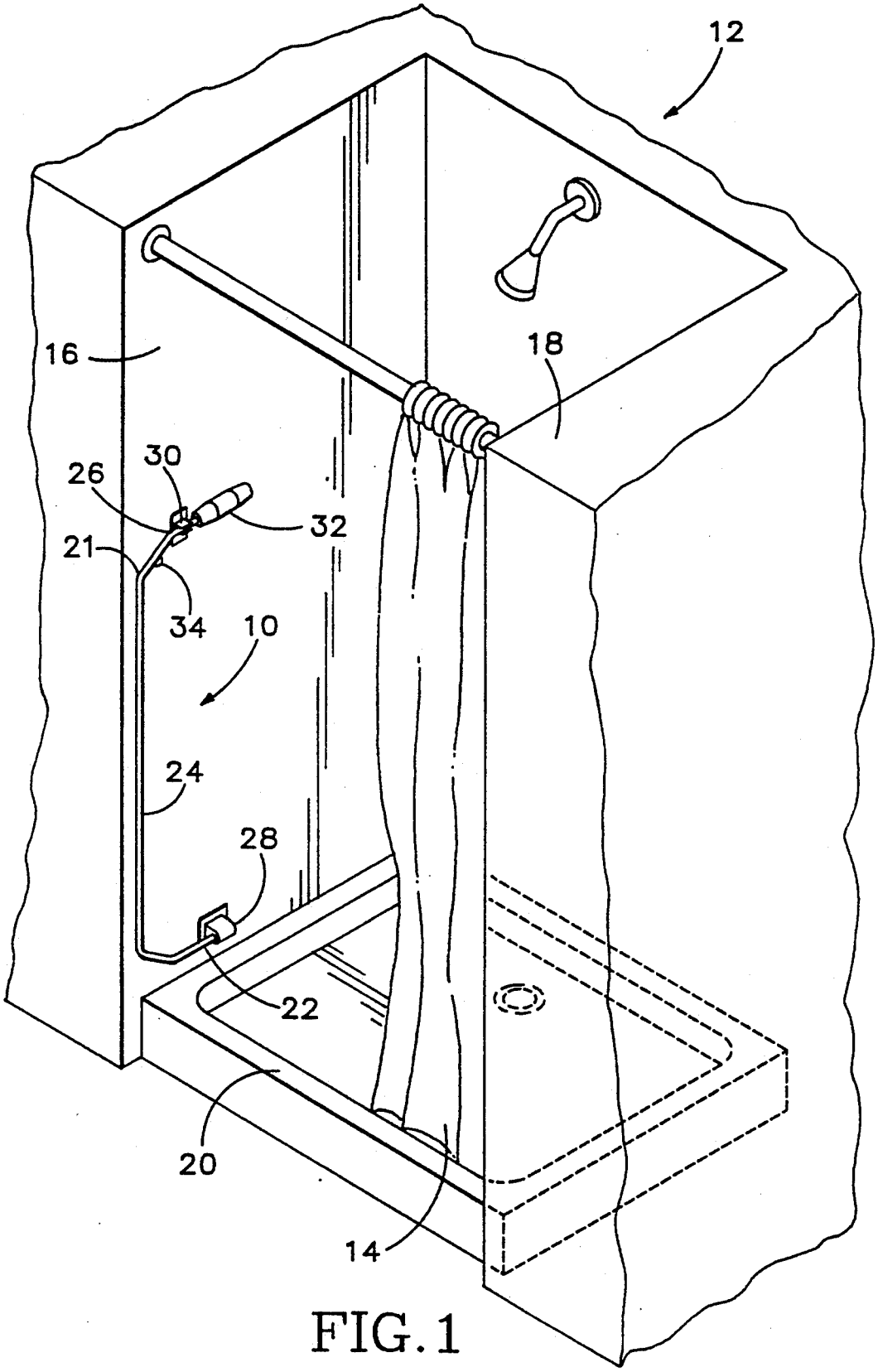
FIG. 1 is a perspective view of a shower curtain brace in its non-use-position installed in a shower in accordance with a preferred embodiment of the present invention.

As shown in FIG. 1, a shower brace 10 is assembled and installed into operative condition in a shower stall 12 including a shower curtain 14 which may be drawn between a first shower wall 16 and a second shower wall 18 above a shower entrance ledge 20. The brace 10 includes a bar member 21 made of three sections. A first end portion 22 of the bar is connected to a longer substantially straight middle portion 24 which is connected to the second end portion 26. The first end portion 22 of the bar 21 is attached to the shower wall 16 by a hinge 28 which permits the bar 21 to pivot in a plane which is substantially perpendicular to the first and second shower walls, from a "non-use-position", as shown in FIG. 1, to a "use-position", as shown and discussed in more detail below.

A clip 30 is attached to the shower wall 16 above hinge 28 in a suitable location to capture and hold the second end portion 26 of the bar 21 when the brace is in its non-use-position. The second end portion 26 is also equipped with a roller 32 to facilitate easy movement of the second end portion of the bar along the surface of the shower wall 18, preferably pinning the curtain between the roller 32 and the wall 18, when the brace is placed into its use-position.

A larger view of the brace is shown in FIG. 2. The middle portion 24 of the bar 21 is broken away to indicate that the length of the bar is variable and is dependant on the distance between the first and second walls 16 and 18 which are adjacent to the shower wall entrance ledge 20. In some instances it is desirable to insert a telescoping mechanism in the middle portion 24 of the bar 21 so that the length of the brace may be varied in order to accommodate showers of different sizes. The bar may be solid or tubular and may be made of metal or plastic.

In FIG. 2 the brace 10 is shown in its non-use-position. The first end portion of the bar 21 is pivotally attached to the wall via hinge 28. The second end portion 26 of the bar 21 is secured against the first shower wall by the clip 30. In a preferred embodiment, a tab 34 is located near the second end portion 26 of the bar 21. As shown in FIG. 2, tab 34 is semi-circular and has a diameter of approximately 1½". When the brace is in its use-position, tab 34 can be easily lifted either by hand or foot, thereby causing the bar 21 to release toward its non-use-position.

FIGS. 3*a* and 3*b* are sectional views of the brace shown in FIG. 2. FIGS. 3*a* and 3*b* show the hinge 28 and the clip 30, respectfully, in greater detail.

As shown in FIG. 3*a*, the hinge 28 includes a base portion 40 which is mounted on the shower wall 16. The hinge base 40 is preferably mounted to the wall by a water-proof adhesive, but may also be mounted by screws or other equivalent mechanisms. The hinge 28 has an aperture 41 with an inner diameter corresponding to the outer diameter of the first end portion 22 of the bar 21.

In FIG. 3*b*, the clip 30, similar to the hinge 28, has a base 42 which is mounted against the shower wall 16. The clip 30 has a partial aperture 43 with an inner diameter corresponding to the outer diameter of the second end portion 26 of the bar 21. The clip 30 also has fanned-out flanges 44*a* and 44*b* which permit easy engagement of the second end portion 26 of the bar 21, for securing the brace in its non-use-position.

Figure 5:
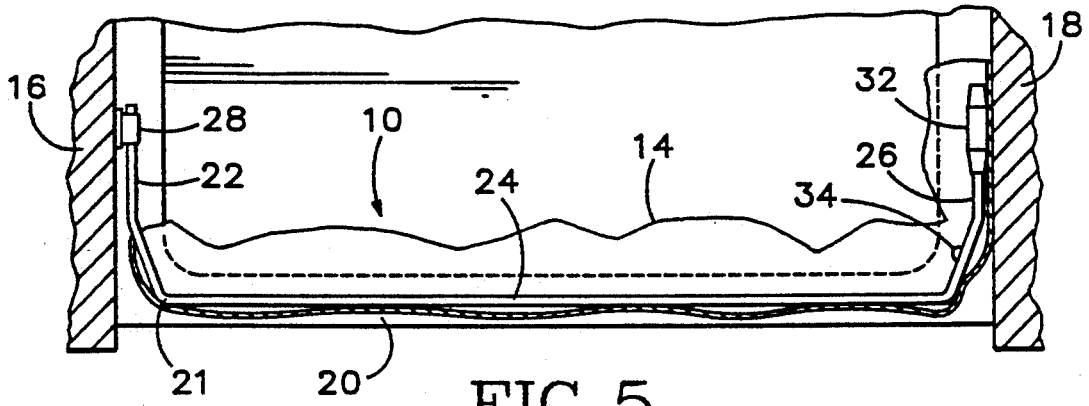
FIG. 5 is a partial sectional view of a shower in which a brace member of the present invention is securing the shower curtain away from the shower space.

FIG. 4 shows a preferred embodiment of the shower brace in its use-position. The shower curtain 14, which is shown in dashed lines, is pinned between the bar 21 and the shower ledge 20. The L-shaped end portions 22 and 26 of the bar 21 allow the curtain to extend around the first and second end portions of the bar 21. As shown in FIGS. 4 and 5, it is preferable for the curtain to actually extend beyond the second end portion 26 of the bar 21. The roller 32 pins the curtain against the second shower wall, thus holding the curtain taut and effectively blocking shower water from exiting the shower compartment. This feature is important because it allows the curtain to seal off the shower entrance and more effectively to block water from exiting the shower stall in comparison to using a straight bar.

FIG. 5 also shows that by pinning the lower portion of the shower curtain 14 against the top of the shower ledge 20 the amount of useable shower space is effectively increased. If no shower brace is used, and even if the shower curtain were not drawn into the shower space by the shower stream, i.e., if the shower curtain hung straight down, the curtain 14 would at least hang inside the shower ledge 20. However, when the shower brace 10 of the present invention is employed, the curtain is pushed back towards the outside of the shower ledge, thus increasing the useable shower space.

Figure 6A:
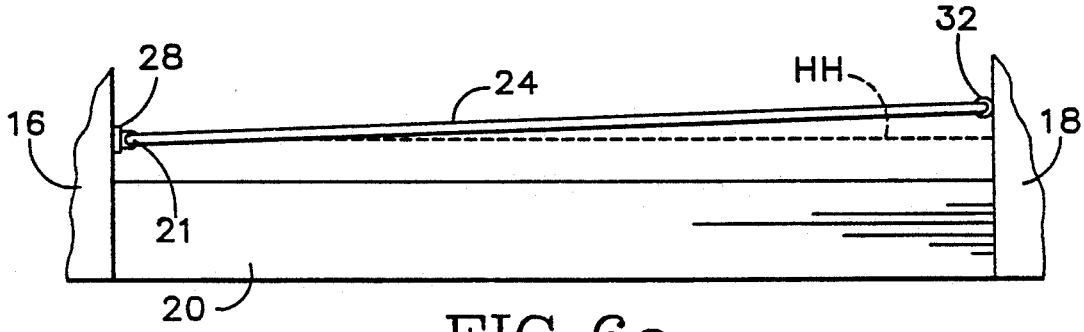
FIG. 6*a* is a partial side view of a brace member in a preferred embodiment of the present invention, in transition between its non-use-position and its use-position.
Figure 6C:
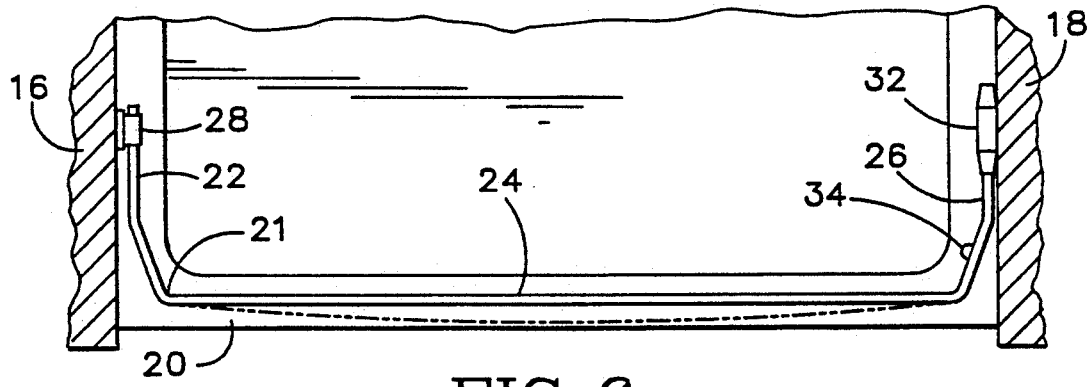
FIG. 6*c* is a partial sectional view of a brace member in a preferred embodiment of the present invention.
Figure 6B:
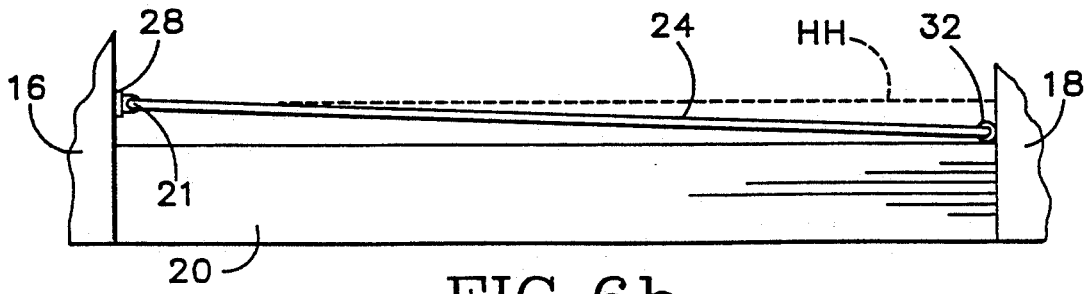
FIG. 6*b* is a partial side view of the brace member shown in FIG. 6*a*, in its use-position.

FIGS. 6*a*, 6*b* and 6*c* illustrate a refinement of the present invention, referred to as a "bow restraint mechanism", which restrains the brace in its use-position. In the brace shown in FIGS. 6*a*–6*c*, the distance between the first end portion 22 and the second end portion 26 of the bar 21 is slightly greater than the horizontal distance HH between first shower wall 16 and second shower wall 18.

Therefore, as shown in FIG. 6*a*, the second end portion of the bar 21 contacts the second shower wall 18 before the middle portion 24 of the bar 21 reaches a horizontal position, i.e., perpendicular to the shower walls.

FIG. 6*b* shows the brace after the bar 21 has been urged past the horizontal orientation along line HH into its use-position in which the second end portion of the bar 21 continues to contact second shower wall 18.

FIG. 6*c* shows a top view of the brace in its use-position, and shows by dashed line, the bowing of the middle portion 24 of the bar which takes place as the bar moves through the horizontal orientation.

It can be seen in FIGS. 6*a*–6*c* that the friction-reducing roller 32 on the second end portion of the bar 21 is particularly helpful when using the bow restraint mechanism for facilitating easy movement of the brace into its use-position. The bow restraint mechanism urges the brace to stay in its use-position, pinning down the lower portion of the shower curtain until the user applies sufficient upward force, preferably against tab 34, to bow the bar 21 and move the bar past the horizontal orientation back to its non-use-position.

Although the preferred embodiments have been shown and discussed in detail, the claimed invention is intended to cover alterations or modifications which are consistent with the spirit and scope of the invention as claimed below.

I claim:

1. A brace for securing a shower curtain away from a shower stream when the shower curtain is extended across the shower entrance above a shower edge between first and second shower walls comprising:

a bar member having first end portion and second L-shaped end portion separated by a distance approximately equivalent to the distance between the first and second shower walls;

a hinge device connected to said first end portion for pivotally fastening the first end portion of the bar member to the first shower wall and allowing the bar member to move between a non-use-position in which the bar member is substantially vertically disposed parallel to the shower walls, and a use-position in which the bar crosses the shower entrance in a substantially perpendicular orientation to the shower walls pinning the shower curtain firstly against an upper surface of the shower ledge and said L-shaped end portion pinning said shower curtain secondly against the second shower wall so that the shower curtain is held substantially away from the shower stream and shower water is prevented from exiting across the shower entrance.

2. The brace of claim 1 wherein the first and second end portions of the bar are separated by a middle portion, each end portion being curved into a substantially perpendicular orientation relative to the middle portion of the bar.

3. The brace of claim 1 further comprising:

a clip mountable on the first shower wall above the hinge device for holding the second end portion of the bar member when the bar member is in the non-use-position.

4. The brace of claim 1 further comprising:

a tab attached to the bar member near the second end portion for providing a contact point against which force may be applied to urge the bar member in and out of its use-position.

5. The brace of claim 1 wherein the second end portion of the bar member has a friction-reducing device capable of allowing the second end portion to move smoothly against the curtain along the second shower wall as the bar member moves into the use-position.

6. A brace for securing a shower curtain away from a shower stream when the shower curtain is extended across the shower entrance above a shower ledge between first and second shower walls comprising:

a bar member having a middle portion and first and second end portions separated by a distance approximately equivalent to the distance between the first and second shower walls;

a hinge device for pivotally fastening the first end of the bar member to the first shower wall and allowing the bar member to move between a non-use-position in which the bar member is substantially vertically disposed parallel to the shower walls, and a use-position in which the bar crosses the shower entrance in a substantially perpendicular orientation to the shower walls so that the shower curtain is held substantially away from the shower stream and shower water is prevented from exiting across the shower entrance, the first and second end portions of the bar being separated by a middle portion, each end portion being curved into a substantially perpendicular orientation relative to the middle portion of the bar, wherein the second end portion of the bar member has a friction-reducing device capable of allowing the second end portion to move against the curtain along the second shower wall as the bar member is moved into the use-position.

7. A brace for securing a shower curtain away from a shower stream when the shower curtain is extended across the shower entrance above a shower ledge between first and second shower walls comprising:

a bar member having first and second end portions separated by a distance approximately equivalent to the distance between the first and second shower walls;

a hinge device for pivotally fastening the first end of the bar member to the first shower wall and allowing the bar member to move between a non-use-position in which the bar member is substantially vertically disposed parallel to the shower walls, and a use-position in which the bar crosses the shower entrance is a substantially perpendicular orientation to the shower walls so that the curtain is held substantially away from the shower stream and shower water is prevented from exiting across the shower entrance, the bar member being contoured and mounted so that when it is in the use position it pins a portion of the shower curtain against an upper surface of the shower ledge, wherein the distance between the first and second end portions of the bar is slightly greater than the distance between the first and second shower walls so that the bar member bows slightly when moving between the non-use-position and the use-position where the bar member is urged to remain.

8. A shower curtain brace comprising:

a bar having a first end section and a second L-shaped end section; and a hinge member including a mounting mechanism for securing the hinge member to a first shower wall opposite from a second shower wall, and a bracket mechanism for pivotally holding the first end section of the bar, so that the bar is moveable between a non-use-position in which the bar is substantially parallel and adjacent to the shower walls, and a use-position in which the bar is substantially parallel to a shower floor and the second L-shaped end section pins the curtain against the second shower wall whereby the bar prevents the curtain from moving into the shower space.

9. The shower curtain brace of claim 8 further comprising a clip mountable on the shower wall for receiving the second L-shaped end section of the bar, thus securing the brace in the non-use-position.

10. The shower curtain brace of claim 8 further comprising a tab attached to the bar near the second L-shaped end section for providing a point of contact against which force may be applied to urge the bar in and out of the use-position.

11. The shower curtain brace of claim 8 further comprising:

a friction-reducing device on the second L-shaped end of the bar so that the bar moves smoothly against the curtain when the bar moves into the use-position.

12. A shower curtain brace comprising:

a bar having first and second L-shaped end sections; and a hinge member including a mounting mechanism for securing the hinge member to a shower wall, and a bracket mechanism for pivotally holding the first end section of the bar, so that the bar is moveable between a non-use-position in which the bar is substantially parallel and adjacent to the shower wall, and a use-position in which the bar is substantially parallel to the shower floor whereby the bar impinged against the shower curtain preventing the curtain from moving into the shower space; and a friction-reducing device on the second L-shaped end of the bar so that the bar may be more easily moved into the use-position.

13. The shower curtain brace of claim 12 wherein the friction-reducing device is a roller.

* * * * *